US006227177B1

(12) United States Patent
Yamafuji et al.

(10) Patent No.: US 6,227,177 B1
(45) Date of Patent: May 8, 2001

(54) APPARATUS FOR CONTROLLING INTERNAL COMBUSTION ENGINE EQUIPPED WITH EVAPORATIVE EMISSION CONTROL SYSTEM

(75) Inventors: Takahiro Yamafuji; Yasuo Kouda, both of Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/339,122

(22) Filed: Jun. 24, 1999

(30) Foreign Application Priority Data

Jul. 7, 1998 (JP) ..... 10-191997

(51) Int. Cl.[7] ..... F02M 37/04
(52) U.S. Cl. ..... 123/520; 123/399
(58) Field of Search ..... 123/698, 520, 123/704, 516, 518, 519, 399

(56) References Cited

U.S. PATENT DOCUMENTS

| | | | | |
|---|---|---|---|---|
| 4,748,959 | * | 6/1988 | Cook et al. | 123/520 |
| 5,048,492 | * | 9/1991 | Davenport et al. | 123/520 |
| 5,090,388 | * | 2/1992 | Hamburg et al. | 123/698 |
| 5,176,123 | * | 1/1993 | Hosoda et al. | 123/520 |
| 5,404,862 | * | 4/1995 | Ohta et al. | 123/698 |
| 5,406,927 | * | 4/1995 | Kato et al. | 123/698 |
| 5,497,757 | * | 3/1996 | Osanai | 123/698 |
| 5,499,617 | * | 3/1996 | Kitajima et al. | 123/698 |
| 5,520,160 | * | 5/1996 | Aota et al. | 123/698 |
| 5,570,674 | * | 11/1996 | Izumiura | 123/698 |
| 5,626,122 | * | 5/1997 | Azuma | 123/698 |
| 5,657,737 | * | 8/1997 | Ishida et al. | 123/698 |
| 5,680,849 | * | 10/1997 | Morikawa et al. | 123/520 |
| 5,791,321 | * | 8/1998 | Kondoh | 123/698 |
| 5,823,171 | * | 10/1998 | Farmer et al. | 123/704 |
| 6,102,003 | * | 8/2000 | Hyodo et al. | 123/520 |

FOREIGN PATENT DOCUMENTS 63-55357 3/1988 (JP) .

* cited by examiner

*Primary Examiner*—Thomas N. Moulis
(74) *Attorney, Agent, or Firm*—Foley & Lardner

(57) ABSTRACT

In an apparatus for controlling an internal combustion engine equipped with an evaporative emission control system comprises an electronic control unit configured to be connected to at least an electronically-controlled throttle and an electronic fuel injection system, the control unit comprises a desired air flow rate setting section setting a desired air flow rate on the basis of at least an opening of an accelerator, and a desired fuel-flow quantity setting section setting a desired quantity of fuel flow on the basis of the desired air flow rate and a predetermined air/fuel ratio. A purge gas flow detection section is provided for detecting a purge-air flow rate of purge air flowing through the purge line and a purge fuel-flow quantity of purge fuel vapor flowing through the purge line. A desired throttle air flow rate is arithmetically calculated by subtracting the purge-air flow rate from the desired air flow rate, whereas a desired fuel-injection quantity is arithmetically calculated by subtracting the purge fuel-flow quantity from the desired quantity of fuel flow. The opening of the electronically-controlled throttle is controlled on the basis of the desired throttle air flow rate, whereas the fuel-injection quantity of fuel to be injected from the fuel injector is controlled on the basis of the desired fuel-injection quantity.

7 Claims, 2 Drawing Sheets

APPARATUS FOR CONTROLLING INTERNAL COMBUSTION ENGINE EQUIPPED WITH EVAPORATIVE EMISSION CONTROL SYSTEM

BACKGROUND OF THE INVENTION

1. Field of the Invention

The present invention relates to an apparatus for controlling an internal combustion engine equipped with an evaporative emission control system that captures or traps any fuel vapors coming from a fuel tank mainly when the engine is not running and prevents them from escaping into atmosphere.

2. Description of the Prior Art

As is generally known, a typical evaporative emission control system for an internal combustion engine, has a carbon or charcoal canister filled with activated carbon or charcoal for temporarily storing, trapping or adsorbing fuel vapors emitted from a fuel tank, and a purge control valve disposed in a purge line connecting an induction system with the canister. Generally, the action of clearing or removing the trapped fuel vapor from the canister is called "purging". An electronic air-fuel mixture ratio control system for an internal combustion engine equipped with an evaporative emission control system as discussed above, has been disclosed in Japanese Patent Provisional Publication No. 63-55357. In the air-fuel ratio control system disclosed in the Japanese Patent Provisional Publication No. 63-55357, a flow rate of air passing through a throttle valve is detected, a basic value of a desired fuel-injection amount is, first of all, set on the basis of the air flow rate detected. On the other hand, during a so-called closed-loop mode, an engine control unit (ECU) executes engine air/fuel ratio feedback control in response to a voltage signal from an oxygen sensor, to set a final desired fuel injection amount and to maintain the engine air/fuel ratio almost at a constant value (that is, at as close to stoichiometric as possible), regardless of the presence or absence of fuel vapors escaping from the fuel tank.

SUMMARY OF THE INVENTION

In the presence of excessively increased amount of fuel vapors, there is a tendency that the air/fuel ratio control mode deviates from the closed-loop feedback control zone. In such a case, the air/fuel ratio will become excessively rich (too much fuel), thereby increasing harmful exhaust emissions, and deteriorating vehicle driveability. For the reasons set out above, when the air/fuel ratio control mode is out of the feedback control zone, the opening of the purge control valve would be decreasingly compensated for. In other words, when the engine is operating out of the closed-loop feedback control operating mode, the decreased opening of the purge control valve limits the amount of purging to a small amount. In hot weather (at high ambient temperatures), there is a large amount of fuel vapor from the fuel tank. Thus, if the canister is insufficiently purged of fuel vapor owing to the undesiredly decreased opening of the purge control valve and additionally the canister has a small capacity, there is a possibility of fuel vapor leakage from the canister into the atmosphere. Depending on variations in the flow rate of purge air and variations in the quantity of purge fuel vapor, correction of a fuel-injection amount would be made through only the air/fuel ratio closed-loop feedback control. The response delay of the feedback control system may lower the accuracy of the air/fuel ratio control system or the follow-up performance of the system, thus resulting in undesirable system hunting (that is, fluctuations in the air/fuel ratio).

Accordingly, it is an object of the invention to provide an apparatus for controlling an internal combustion engine equipped with an evaporative emission control system which avoids the aforementioned disadvantages of the prior art.

It is another object of the invention to provide an integrated engine control apparatus of an internal combustion engine equipped with an evaporative emission control system, which is capable of executing high-precision A/F ratio control of an enhanced follow-up performance even in the presence of remarkable variations in the purge air flow rate and purge fuel-vapor quantity, without undesiredly limiting canister purging to a small amount of purging.

In order to accomplish the aforementioned and other objects of the present invention, an apparatus for controlling an internal combustion engine equipped with an evaporative emission control system having at least a canister temporarily adsorbing fuel vapor emitted from a fuel tank, a purge line through which the fuel vapor adsorbed by the canister flows to an induction system, and a purge control valve disposed in the purge line, the apparatus comprises a control unit configured to be connected to at least an electronically-controlled throttle and an electronic fuel injection system having a fuel injector provided for each engine cylinder, the control unit comprising a desired air flow rate setting section setting a desired air flow rate on the basis of at least an opening of an accelerator, a desired fuel-flow quantity setting section setting a desired quantity of fuel flow on the basis of at least the opening of the accelerator, a purge-air flow rate detection section detecting a purge-air flow rate of purge air flowing through the purge line via the purge control valve to the induction system, a purge fuel-flow quantity detection section detecting a purge fuel-flow quantity of purge fuel vapor flowing through the purge line via the purge control valve to the induction system, a desired throttle air flow rate arithmetic-calculation section arithmetically calculating a corrected air flow rate by subtracting the purge-air flow rate from the desired air flow rate, a throttle control section controlling an opening of the electronically-controlled throttle on the basis of the corrected air flow rate, a desired fuel-injection quantity arithmetic-calculation section arithmetically calculating a corrected fuel-injection quantity by subtracting the purge fuel-flow quantity from the desired quantity of fuel flow, and a fuel-injection control section controlling a fuel-injection quantity of fuel to be injected from the fuel injector on the basis of the corrected fuel-injection quantity.

According to another aspect of the invention, in an internal combustion engine equipped with an evaporative emission control system having at least a canister temporarily adsorbing fuel vapor emitted from a fuel tank, a purge line through which the fuel vapor adsorbed by the canister flows to an induction system, and a purge control valve disposed in the purge line, an integrated engine control apparatus for electronically controlling an air/fuel ratio, comprises an electronically-controlled throttle whose opening is changeable arbitrarily in response to an opening of an accelerator, an electronic fuel injection system having a fuel injector provided for each engine cylinder, control means configured to be connected to at least the electronically-controlled throttle, the electronic fuel injection system, and the purge control valve, for controlling the air/fuel ratio, the control means comprising a desired air flow rate setting means for setting a desired air flow rate on the basis of at least the opening of the accelerator, a desired fuel-flow quantity setting means for setting a desired quantity of fuel flow on the basis of at least the opening of the accelerator, a purge-air flow rate estimation means for estimating a purge-air flow rate of purge air flowing through the purge line via the purge control valve to the induction system on the basis of both an opening of the purge control valve and a negative pressure in the induction system, a purge fuel-flow quantity estimation means for estimating a purge fuel-flow quantity of purge fuel vapor flowing through the purge line via the purge control valve to the induction system on the basis of both the purge air flow rate estimated by the purge-air flow rate estimation means and a concentration of hydrocarbon contained within purge gas consisting of the purge air and the purge fuel vapor flowing through the purge line, a desired throttle air flow rate arithmetic-calculation means for arithmetically calculating a corrected air flow rate by subtracting the purge-air flow rate from the desired air flow rate, a throttle control means for controlling an opening of the electronically-controlled throttle on the basis of the corrected air flow rate, a desired fuel-injection quantity arithmetic-calculation means for arithmetically calculating a corrected fuel-injection quantity by subtracting the purge fuel-flow quantity from the desired quantity of fuel flow, and a fuel-injection control means for controlling a fuel-injection quantity of fuel to be injected from the fuel injector on the basis of the corrected fuel-injection quantity.

According to a further aspect of the invention, a method for controlling an air/fuel ratio of an internal combustion engine, wherein the internal combustion engine includes an electronically-controlled throttle whose opening is changeable arbitrarily in response to an opening of an accelerator, an electronic fuel injection system having a fuel injector provided for each engine cylinder, and an evaporative emission control system having at least a canister temporarily adsorbing fuel vapor emitted from a fuel tank, a purge line through which the fuel vapor adsorbed by the canister flows to an induction system, and a purge control valve disposed in the purge line, the method comprises setting a desired air flow rate on the basis of at least the opening of the accelerator, setting a desired quantity of fuel flow on the basis of at least the opening of the accelerator, estimating a purge-air flow rate of purge air flowing through the purge line via the purge control valve to the induction system on the basis of both an opening of the purge control valve and a negative pressure in the induction system, estimating a purge fuel-flow quantity of purge fuel vapor flowing through the purge line via the purge control valve to the induction system on the basis of both the purge air flow rate estimated and a concentration of hydrocarbon contained within purge gas consisting of the purge air and the purge fuel vapor flowing through the purge line, arithmetically calculating a corrected air flow rate by subtracting the purge-air flow rate from the desired air flow rate, controlling an opening of the electronically-controlled throttle on the basis of the corrected air flow rate, arithmetically calculating a corrected fuel-injection quantity by subtracting the purge fuel-flow quantity from the desired quantity of fuel flow, and controlling a fuel-injection quantity of fuel to be injected from the fuel injector on the basis of the corrected fuel-injection quantity.

According to a still further aspect of the invention, a method for controlling an air/fuel ratio of an internal combustion engine, wherein the internal combustion engine includes an electronically-controlled throttle whose opening is changeable arbitrarily in response to an opening of an accelerator, an electronic fuel injection system having a fuel injector provided for each engine cylinder, and an evaporative emission control system having at least a canister temporarily adsorbing fuel vapor emitted from a fuel tank, a purge line through which the fuel vapor adsorbed by the canister flows to an induction system, and a purge control valve disposed in the purge line, the method comprises detecting engine speed, the opening of the accelerator, an opening of the purge control valve, a negative pressure in the induction system, and a concentration of hydrocarbon contained within purge gas consisting of purge air and purge fuel vapor flowing through the purge line, setting a desired air flow rate on the basis of the engine speed and the opening of the accelerator, setting a desired quantity of fuel flow on the basis of the desired air flow rate and a predetermined air/fuel ratio, estimating a purge-air flow rate of purge air flowing through the purge line via the purge control valve to the induction system on the basis of both the opening of the purge control valve and the negative pressure in the induction system, estimating a purge fuel-flow quantity of purge fuel vapor flowing through the purge line via the purge control valve to the induction system on the basis of both the purge air flow rate estimated and a concentration of hydrocarbon contained within purge gas consisting of the purge air and the purge fuel vapor flowing through the purge line, arithmetically calculating a corrected air flow rate by subtracting the purge-air flow rate from the desired air flow rate, controlling an opening of the electronically-controlled throttle on the basis of the corrected air flow rate, arithmetically calculating a corrected fuel-injection quantity by subtracting the purge fuel-flow quantity from the desired quantity of fuel flow, and controlling a fuel-injection quantity of fuel to be injected from the fuel injector on the basis of the corrected fuel-injection quantity.

DESCRIPTION OF THE PREFERRED EMBODIMENTS

Figure 1:
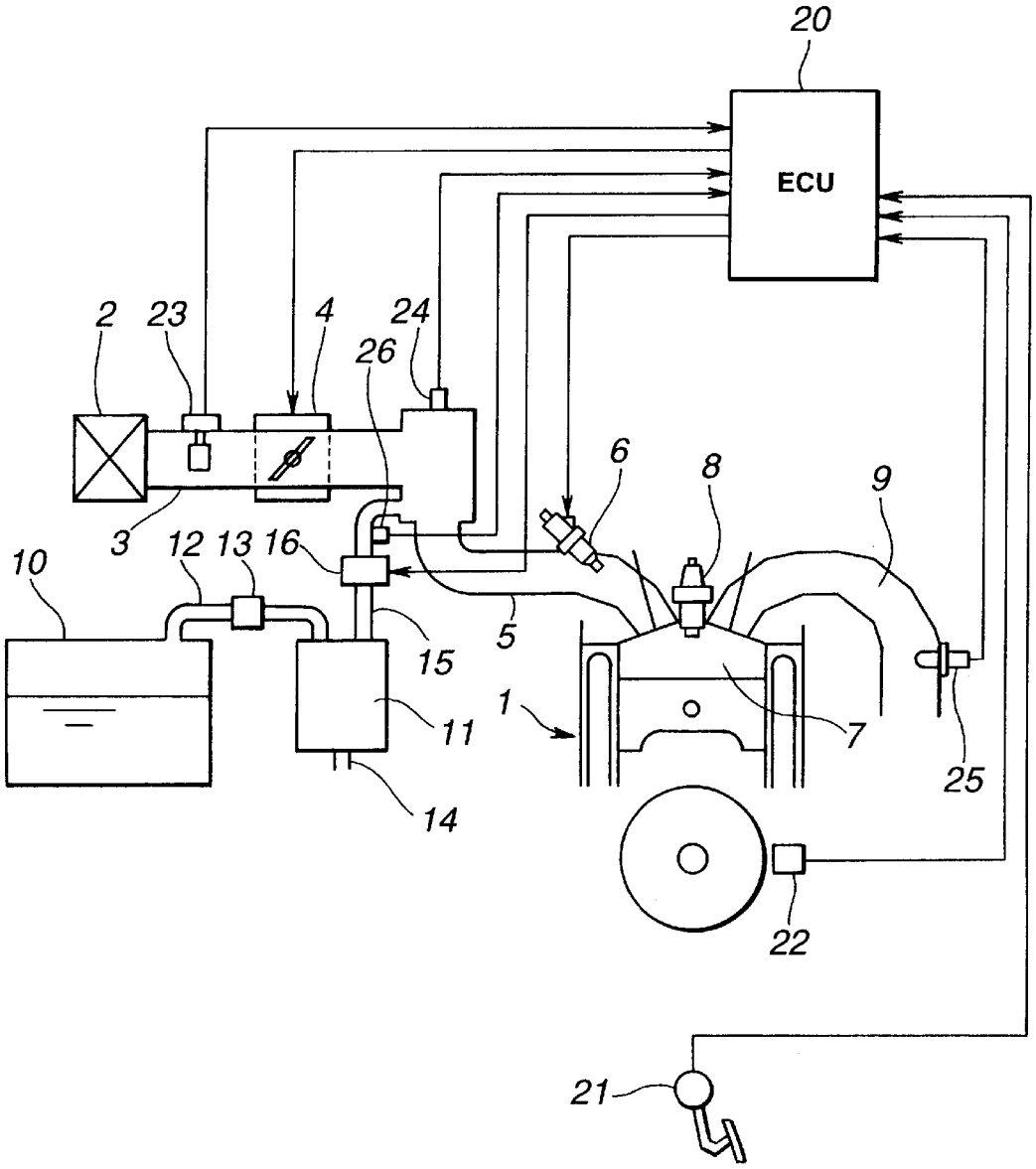
FIG. 1 is a system diagram illustrating one embodiment of an integrated engine control apparatus of the invention.

Referring now to the drawings, particularly to FIG. 1, the integrated internal combustion engine control apparatus of the invention is exemplified in case of a spark-ignition gasoline engine. As seen in Fig, 1, the induction system of the engine 1 comprises an air cleaner 2, an air-intake duct 3, an electronically-controlled throttle valve 4, and an intake manifold 5. In order to control or regulate a flow rate of fresh air induced into engine cylinders, the opening of the electronically-controlled throttle 4 is controlled in response to a control signal or a command from an electronic control module (ECM) or an electronic control unit (ECU) 20 which will be fully described later. Electromagnetically-powered and electronically-controlled fuel injectors 6 are located within the respective branched portions of the intake manifold 5 for delivering fuel, regulated to a given fuel pressure, to each engine cylinder. The opening and closing of each of the fuel injectors 6 can be electronically controlled by a pulse-width modulated (PWM) duty-cycle signal (pulses output from the output interface of the ECU to each injector solenoid in synchronization with engine revolutions). In the same manner as a typical fuel injection system, the amount of fuel delivered to each cylinder is thus controlled by the pulse-width time (the controlled duty-cycle value). In the shown embodiment, although the fuel injectors 6 are arranged within the branched portions of the intake manifold to inject fuel into the respective intake-valve ports and the apparatus of the invention is exemplified in the port-injected type internal combustion engine, the apparatus may be applied to an in-cylinder direct injection type internal combustion engine in which fuel is injected directly into the combustion chamber. As seen in FIG. 1, a spark plug 8 is screwed into the cylinder head of the engine 1 so that its electrodes project into the combustion chamber 7 to ignite the air-fuel mixture in the combustion chamber 7. On exhaust stroke, burned gases are exhausted or removed from the combustion chamber 7 through the exhaust valve (not numbered) to an exhaust manifold 9. In order to temporarily capture, trap or adsorb evaporative emission (fuel vapors) escaped from a fuel tank 10, a carbon or charcoal canister 11 filled with adsorbent such as activated carbon or charcoal particles contained in the canister body. A fuel-tank vapor vent line 12 is connected via a check valve (or an overfill limiting valve) 13 to an inlet port of the canister 11. The check valve 13 serves as a vapor-liquid separating device which prevents liquid fuel from flowing to the canister 11. Fuel vapors emitted from the fuel tank 10 are transferred through the fuel-tank vent line 12 via the check valve 13 to the canister 11, and then trapped or adsorbed by the activated carbon or charcoal particles contained in the canister body. "Adsorb" means the fuel vapors are trapped by sticking to the outside of the activated carbon or charcoal particles. The activated carbon or charcoal canister 11 has a fresh-air inlet tube 14 formed at the closed bottom of the canister, for introducing fresh air therethrough into the canister. The canister 11 is also formed with a purge line 15 through which the canister is connected to the collector of the intake manifold 5. As seen in FIG. 1, an electromagnetically-powered canister purge control valve 16 is fluidly disposed in the purge line 15. In the embodiment, an electromagnetic solenoid valve is used as the purge control valve 16. The electromagnetic solenoid valve is usually referred to as a "canister purge solenoid valve". The purge control valve 16 is opened in response to a control signal or a command output from the ECU 20 under predetermined operating conditions (canister-purging permission conditions) when the engine 1 is running. In other words, the ECU 20 allows canister purging to occur only after all of the predetermined canister-purging permission conditions (for example, engine temperature (engine coolant temperature) above a predetermined temperature value, and the like) are met when the engine is running. On the other hand, when the engine is stopped or if the previously-noted predetermined canister-purging permission conditions are unsatisfied, the canister purge solenoid closes the purge control valve 16 and therefore blocks any engine vacuum to the canister purge control valve 16. When the engine 1 is started and then the predetermined canister-purging permission conditions are met, the purge control valve 16 is opened and thus engine vacuum (intake-manifold vacuum) is admitted to the canister 11. As a result of this, the engine vacuum draws fresh air up through the canister 11 via the fresh-air inlet tube 14. The fresh air flowing through the interior of the canister 11, picks up these trapped fuel vapors, and removes or purges the trapped fuel vapors from the activated carbon or charcoal element canister 11. The purge gas (containing the removed fuel vapors, i.e., hydrocarbon (HC) vapors) is recirculated or sucked into the collector of the intake manifold 5 through the purge line 15. Thereafter, the purge gas is burned in the combustion chamber 7. In general, the ECU 20 controls the engine vacuum to the canister purge solenoid of the purge control valve 16 by way of duty-cycle control, so that the opening of the purge control valve 16 is dependent on the PWM duty-cycle signal output to the canister purge solenoid.

In order to perform a series of integrated engine control procedures (see the arithmetic-calculation shown in FIG. 2) related to the air/fuel ratio control system (containing the electronic fuel-injection system with the fuel injectors 6 and the electronically-controlled throttle valve 4), while considering the purge air flow rate and purge fuel-vapor quantity of the evaporative emission control system (containing the canister purge solenoid of the purge control valve 16), the input interface of the ECU 20 receives various signals (input information data, APO, Ne, Qac, PB, λ (lambda), HCS) from engine/vehicle sensors, namely an accelerator position sensor 21, a crank angle sensor 22, an air-flow meter 23, a negative pressure sensor 24, an oxygen sensor 25, and a hydrocarbon (HC) sensor 26. The ECU 20 is generally comprised of a microcomputer that is typical of that now in use many passenger cars and trucks. Although it is not clearly shown, the ECU 20 usually contains an input/output interface (or input and output interface circuits), a central processing unit (CPU), a memory device (RAM/ROM), and an analog-to-digital converter (A/D converter). The accelerator pedal sensor 21 is located near at the accelerator pedal to detect the opening APO of the accelerator (the depression amount of the accelerator pedal). The crank angle sensor 22 outputs a voltage signal for each predetermined crank angle of the engine crankshaft to monitor engine speed Ne. The air-flow meter 23 is located in the intake-air passage between the air cleaner 2 and the electronically-controlled throttle valve 4, for detecting an actual air-flow rate Qac of fresh air flowing through the intake-air passage. The negative pressure sensor 24 is attached to the intake manifold 5 to detect an intake-manifold pressure (a negative pressure PB in the intake manifold 5). The oxygen sensor ($O_2$ sensor) 25 is provided at the exhaust passage (the exhaust manifold 9), so that its sensing element is exposed to exhaust-gas flow to detect the percentage of oxygen contained within the engine exhaust gases and to monitor whether the air/fuel ratio λ is rich or lean. The hydrocarbon (HC) sensor 26 is attached to the purge line 15 downstream of the purge control valve 16, to detect the concentration HCS of hydrocarbon contained within the purge gas (the purge air and fuel vapor flow through the purge line). As a hydrocarbon sensor, the integrated engine control apparatus of the embodiment uses a thermal-conductivity type HC sensor which detects a concentration of hydrocarbon by way of the thermal-conductivity difference between the hydrocarbon vapor (the purge fuel vapor) and the reference gas (the purge air). It is possible to more accurately detect or monitor the purge fuel vapor quantity by way of the use of the hydrocarbon sensor 26.

Figure 2:
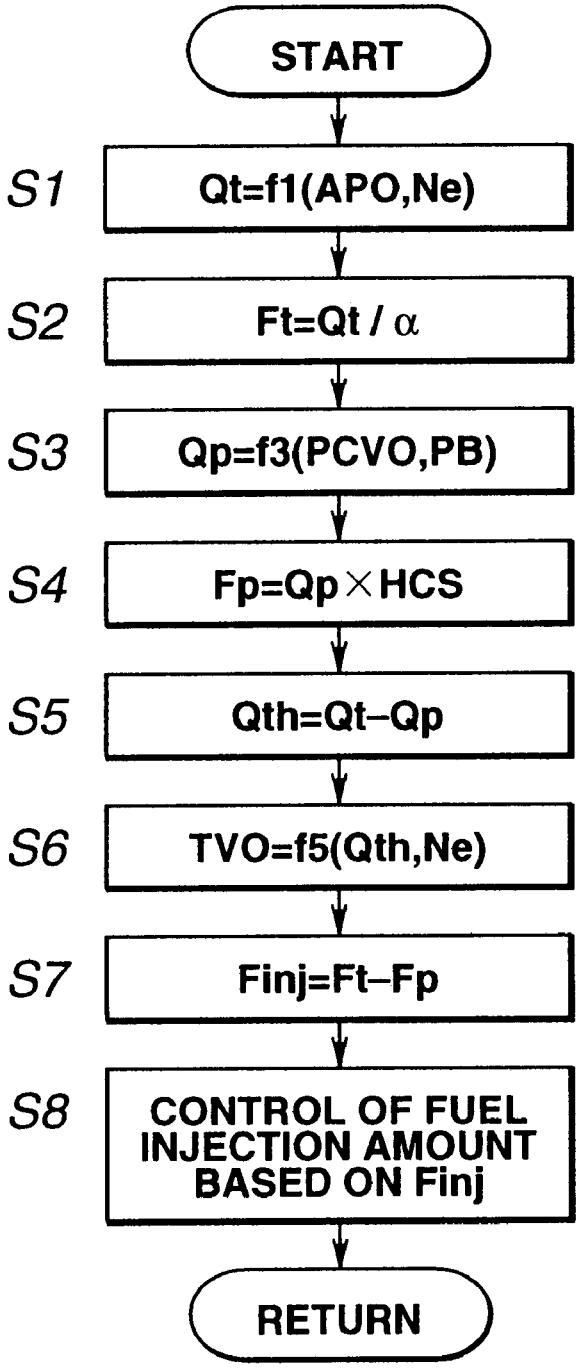
FIG. 2 is a flow chart illustrating an A/F ratio control routine executed by an electronic control unit (ECU) of the integrated engine control apparatus shown in FIG. 1.

Referring now to FIG. 2, there is shown the air/fuel (A/F) ratio control routine or the arithmetic-calculation executed by the CPU of the ECU 20 incorporated in the engine control apparatus of the embodiment.

The arithmetic processing or the control routine shown in FIG. 2 is executed as time-triggered interrupt routines to be triggered every predetermined sampling intervals.

In step S1, first of all, the accelerator opening indicative data APO and the engine speed indicative data Ne are read. Then, a desired air flow rate Qt is set or retrieved as a function f1(APO, Ne) of both the accelerator opening indicative data APO and the engine speed indicative data Ne from a predetermined or preprogrammed three-dimensional characteristic map showing the relationship among the engine speed Ne, the accelerator opening APO, and the desired air flow rate Qt. Alternatively, the desired air flow rate Qt may be retrieved as a function of at least the accelerator opening APO from a predetermined or preprogrammed two-dimensional characteristic map showing the relationship between the accelerator opening APO and the desired air flow rate Qt. Step 1 serves as a desired air flow rate (Qt) setting section. In step S2, a desired quantity Ft of fuel flow is arithmetically calculated or computed on the basis of both the desired air flow rate Qt and a predetermined air/fuel ratio threshold or a desired air/fuel ratio $\alpha$ from a predetermined expression $Ft=Qt/\alpha$. As discussed above, in setting or determining the desired fuel-flow quantity Ft, the apparatus of the embodiment utilizes the desired airflow rate Qt calculated at step S1 and the preprogrammed desired air/fuel ratio $\alpha$. This facilitates the arithmetic calculation of the desired fuel-flow quantity Ft. In lieu thereof, the desired fuel-flow quantity Ft may be calculated or retrieved as a function f2(APO, Ne) of both the accelerator opening indicative data APO and the engine speed indicative data Ne from a predetermined or preprogrammed three-dimensional characteristic map showing the relationship among the engine speed Ne, the accelerator opening APO, and the desired fuel-flow quantity Ft. Alternatively, the desired fuel-flow quantity Ft may be retrieved as a function of at least the accelerator opening APO from a predetermined or preprogrammed two-dimensional characteristic map showing the relationship between the accelerator opening APO and the desired fuel-flow quantity Ft. Step 2 serves as a desired fuel-flow quantity setting section. In step S3, the latest up-to-date purge-control-valve opening indicative data PCVO and the latest up-to-date intake-manifold pressure indicative data PB are read. Then, a purge air flow rate Qp, which is delivered or transferred through the purge line 15 to the intake manifold 5, is detected or estimated as a function f3(PCVO, PB) of both the latest up-to-date purge-control-valve opening indicative data PCVO and the latest up-to-date intake-manifold pressure indicative data PB from a predetermined or preprogrammed three-dimensional characteristic map showing the relationship among the purge-control-valve opening PCVO, the intake-manifold pressure PB, and the purge air flow rate Qp. In the shown embodiment, a value of the command output from the output interface of the ECU 20 to the purge control valve 16 is actually used as the purge-control-valve opening indicative data PCVO. Also, the negative pressure sensor (the intake-manifold pressure sensor) 24 is usually installed on automotive vehicles. There is no necessity of an additional sensor. Step 3 serves as a purge-air flow rate detection section. In step 4, the latest up-to-date hydrocarbon concentration indicative data HCS is read. Thereafter, a purge fuel quantity (or a purge-fuel-vapor quantity) Fp is detected or estimated by multiplying the purge air flow rate Qp with the hydrocarbon concentration HCS according to the expression $Fp=Qp\times HCS$. Alternatively, the purge fuel quantity Fp may be retrieved or estimated as a function f4(Qp, HCS) of both the purge air flow rate Qp detected or estimated and the hydrocarbon concentration HCS detected, from a predetermined or preprogrammed three-dimensional characteristic map showing the relationship among the purge air flow rate Qp, the hydrocarbon concentration HCS, and the purge fuel quantity Fp. Step S4 functions as a purge fuel quantity detection section. In step S5, a desired air flow rate Qth flowing through the electronically-controlled throttle 4, which will be hereinafter referred to as a "desired throttle air flow rate Qth", is arithmetically calculated by subtracting the purge air flow rate Qp from the desired air flow rate Qt, (that is, from the expression $Qth=Qt-Qp$). Step S5 functions as a desired throttle air flow rate arithmetic-calculation section. In step S6, a desired throttle opening TVO is arithmetically calculated or retrieved as a function f5(Qth, Ne) of both the desired throttle air flow rate Qth and the engine speed Ne, from a predetermined or preprogrammed three-dimensional characteristic map showing the relationship among the desired throttle air flow rate Qth, the engine speed Ne, and the desired throttle opening TVO. Then, the opening of the electronically-controlled throttle 4 is regulated or controlled on the basis of the desired throttle opening TVO (=f5(Qth, Ne)) by way of open-loop feedforward control. Step S6 functions as a throttle feedforward control section. In addition to the feedforward control based on the desired throttle opening TVO, it is more preferable that a feedback correction may be executed by comparison (Qac-Qth) between the actual air flow rate Qac measured or detected by the air-flow meter 23 and the desired throttle air flow rate Qth, so that the actual air flow rate Qac is adjusted to the desired throttle air flow rate Qth. In step S7, a desired fuel-injection quantity Finj is arithmetically calculated by subtracting the purge fuel quantity Fp from the desired fuel-flow quantity Ft, (that is, from the expression $Finj=Ft-Fp$). Step S7 functions as a desired fuel-injection quantity arithmetic-calculation section. In step S8, the pulse-width time of the pulse-width modulated (PWM) duty-cycle signal, which is output from the ECU 20 to each fuel injector solenoid, is set or determined on the basis of the desired fuel-injection quantity Finj. That is, the amount of fuel delivered to each individual engine cylinder is determined depending on the desired fuel-injection quantity Finj. Step S8 functions as a fuel-injection control section. In addition to the feedforward control based on the desired fuel-injection quantity Finj, it is more preferable that a feedback correction may be executed by a deviation ($\lambda-\alpha$) of the air/fuel ratio $\lambda$ detected by the oxygen sensor 25 from the desired air/fuel ratio $\alpha$, so that the actual A/F ratio $\lambda$ is adjusted to the desired A/F ratio $\alpha$.

As will be appreciated from the above, according to the integrated engine control apparatus of the invention, the desired air flow rate (Qt) and the desired fuel-flow quantity (Ft) are first determined depending on at least the accelerator opening (APO) substantially equivalent to a desired driving torque, and then these quantities (Qt, Ft) are corrected ($Qth=Qt-Qp$, $Finj=Ft-Fp$) by the purge air flow rate (Qp) and the purge fuel quantity (Fp), respectively. Therefore, the electronically-controlled throttle valve 4 and each fuel injector 6 are rapidly timely controlled by way of the open-loop feedforward control based on the anticipating correction signals (Qth, Finj). Thus, the apparatus of the invention allows the air/fuel ratio to be stably adjusted to its desired value without undesired hunting (overshoot and undershoot), while realizing enhanced follow-up performance of the air/fuel ratio control in the presence of variations in the purge air flow rate and/or variations in the purge fuel vapor quantity. The feedforward control eliminates the necessity for always limiting canister purging to a small amount when the engine is not operating in the closed-loop feedback control operating mode. In other words, the engine air/fuel ratio feedforward control enlarges the opportunity of canister purging operations, thus effectively preventing fuel vapor leakage from the canister into the atmosphere even in hot weather.

The entire contents of Japanese Patent Application No. P10-191997 (filed Jul. 7, 1998) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An apparatus for controlling an internal combustion engine equipped with an evaporative emission control system having at least a canister temporarily adsorbing fuel vapor emitted from a fuel tank, a purge line through which the fuel vapor adsorbed by the canister flows to an induction system, and a purge control valve disposed in the purge line, said apparatus comprising:

a control unit configured to be connected to at least an electronically-controlled throttle and an electronic fuel injection system having a fuel injector provided for each engine cylinder;

said control unit comprising:

a desired air flow rate setting section setting a desired air flow rate on the basis of at least an opening of an accelerator;

a desired fuel-flow quantity setting section setting a desired quantity of fuel flow on the basis of at least the opening of the accelerator;

a purge-air flow rate detection section detecting a purge-air flow rate of purge air flowing through the purge line via the purge control valve to the induction system;

a purge fuel-flow quantity detection section detecting a purge fuel-flow quantity of purge fuel vapor flowing through the purge line via the purge control valve to the induction system;

a desired throttle air flow rate arithmetic-calculation section arithmetically calculating a corrected air flow rate by subtracting the purge-air flow rate from the desired air flow rate;

a throttle control section controlling an opening of the electronically-controlled throttle on the basis of the corrected air flow rate;

a desired fuel-injection quantity arithmetic-calculation section arithmetically calculating a corrected fuel-Injection quantity by subtracting the purge fuel-flow quantity from the desired quantity of fuel flow; and a fuel-injection control section controlling a fuel-injection quantity of fuel to be injected from the fuel injector on the basis of the corrected fuel-injection quantity.

2. The apparatus as claimed in claim 1, wherein said desired fuel-flow quantity setting section arithmetically calculates the desired fuel-flow quantity on the basis of both a predetermined air/fuel ratio and the desired air flow rate.

3. The apparatus as claimed in claim 1, wherein said purge-air flow rate detection section detects both an opening of the purge control valve and a negative pressure in the induction system, and arithmetically calculates the purge-air flow rate on the basis of the opening of the purge control valve and the negative pressure in the induction system.

4. The apparatus as claimed in claim 1, wherein said purge fuel-flow quantity detection section comprises a hydrocarbon sensor attached to the purge line downstream of the purge control valve to detect a concentration of hydrocarbon contained within purge gas consisting of the purge air and the purge fuel vapor, and arithmetically calculates the purge fuel-flow quantity on the basis of both the purge-air flow rate and the concentration of hydrocarbon.

5. In an internal combustion engine equipped with an evaporative emission control system having at least a canister temporarily adsorbing fuel vapor emitted from a fuel tank, a purge line through which the fuel vapor adsorbed by the canister flows to an induction system, and a purge control valve disposed in the purge line, an integrated engine control apparatus for electronically controlling an air/fuel ratio, comprising:

an electronically-controlled throttle whose opening is changeable arbitrarily in response to an opening of an accelerator;

an electronic fuel injection system having a fuel injector provided for each engine cylinder;

control means configured to be connected to at least said electronically-controlled throttle, said electronic fuel injection system, and the purge control valve, for controlling the air/fuel ratio;

said control means comprising:

a desired air flow rate setting means for setting a desired air flow rate on the basis of at least the opening of the accelerator;

a desired fuel-flow quantity setting means for setting a desired quantity of fuel flow on the basis of at least the opening of the accelerator;

a purge-air flow rate estimation means for estimating a purge-air flow rate of purge air flowing through the purge line via the purge control valve to the induction system on the basis of both an opening of the purge control valve and a negative pressure in the induction system;

a purge fuel-flow quantity estimation means for estimating a purge fuel-flow quantity of purge fuel vapor flowing through the purge line via the purge control valve to the induction system on the basis of both the purge air flow rate estimated by the purge-air flow rate estimation means and a concentration of hydrocarbon contained within purge gas consisting of the purge air and the purge fuel vapor flowing through the purge line;

a desired throttle air flow rate arithmetic-calculation means for arithmetically calculating a corrected air flow rate by subtracting the purge-air flow rate from the desired air flow rate;

a throttle control means for controlling an opening of the electronically-controlled throttle on the basis of the corrected air flow rate;

a desired fuel-injection quantity arithmetic-calculation means for arithmetically calculating a corrected fuel-injection quantity by subtracting the purge fuel-flow quantity from the desired quantity of fuel flow; and a fuel-injection control means for controlling a fuel-injection quantity of fuel to be injected from the fuel injector on the basis of the corrected fuel-injection quantity.

6. A method for controlling an air/fuel ratio of an internal combustion engine, wherein the internal combustion engine includes an electronically-controlled throttle whose opening is changeable arbitrarily in response to an opening of an accelerator, an electronic fuel injection system having a fuel injector provided for each engine cylinder, and an evaporative emission control system having at least a canister temporarily adsorbing fuel vapor emitted from a fuel tank, a purge line through which the fuel vapor adsorbed by the canister flows to an induction system, and a purge control valve disposed in the purge line, the method comprising:

setting a desired air flow rate on the basis of at least the opening of the accelerator, setting a desired quantity of fuel flow on the basis of at least the opening of the accelerator, estimating a purge-air flow rate of purge air flowing through the purge line via the purge control valve to the induction system on the basis of both an opening of the purge control valve and a negative pressure in the induction system, estimating a purge fuel-flow quantity of purge fuel vapor flowing through the purge line via the purge control valve to the induction system on the basis of both the purge air flow rate estimated and a concentration of hydrocarbon contained within purge gas consisting of the purge air and the purge fuel vapor flowing through the purge line, arithmetically calculating a corrected air flow rate by subtracting the purge-air flow rate from the desired air flow rate, controlling an opening of the electronically-controlled throttle on the basis of the corrected air flow rate, arithmetically calculating a corrected fuel-injection quantity by subtracting the purge fuel-flow quantity from the desired quantity of fuel flow, and controlling a fuel-injection quantity of fuel to be injected from the fuel injector on the basis of the corrected fuel-injection quantity.

7. A method for controlling an air/fuel ratio of an internal combustion engine, wherein the internal combustion engine includes an electronically-controlled throttle whose opening is changeable arbitrarily in response to an opening of an accelerator, an electronic fuel injection system having a fuel injector provided for each engine cylinder, and an evaporative emission control system having at least a canister temporarily adsorbing fuel vapor emitted from a fuel tank, a purge line through which the fuel vapor adsorbed by the canister flows to an induction system, and a purge control valve disposed in the purge line, the method comprising:

detecting engine speed, the opening of the accelerator, an opening of the purge control valve, a negative pressure in the induction system, and a concentration of hydrocarbon contained within purge gas consisting of purge air and purge fuel vapor flowing through the purge line, setting a desired air flow rate on the basis of the engine speed and the opening of the accelerator, setting a desired quantity of fuel flow on the basis of the desired air flow rate and a predetermined air/fuel ratio, estimating a purge-air flow rate of purge air flowing through the purge line via the purge control valve to the induction system on the basis of both the opening of the purge control valve and the negative pressure in the induction system, estimating a purge fuel-flow quantity of purge fuel vapor flowing through the purge line via the purge control valve to the induction system on the basis of both the purge air flow rate estimated and a concentration of hydrocarbon contained within purge gas consisting of the purge air and the purge fuel vapor flowing through the purge line, arithmetically calculating a corrected air flow rate by subtracting the purge-air flow rate from the desired air flow rate, controlling an opening of the electronically-controlled throttle on the basis of the corrected air flow rate, arithmetically calculating a corrected fuel-injection quantity by subtracting the purge fuel-flow quantity from the desired quantity of fuel flow, and controlling a fuel-injection quantity of fuel to be injected from the fuel injector on the basis of the corrected fuel-injection quantity.

* * * * *